US009303219B2

(12) United States Patent
Dalal

(10) Patent No.: US 9,303,219 B2
(45) Date of Patent: Apr. 5, 2016

(54) METHODS FOR TREATING VACUUM GAS OIL (VGO) AND APPARATUSES FOR THE SAME

(71) Applicant: UOP LLC, Des Plaines, IL (US)

(72) Inventor: Vikrant Vilasrao Dalal, Gurgaon (IN)

(73) Assignee: UOP LLC, Des Plaines, IL (US)

( * ) Notice: Subject to any disclaimer, the term of this patent is extended or adjusted under 35 U.S.C. 154(b) by 189 days.

(21) Appl. No.: 14/141,127

(22) Filed: Dec. 26, 2013

(65) Prior Publication Data

US 2015/0184088 A1 Jul. 2, 2015

(51) Int. Cl.

| | |
|---|---|
| ***C10G 45/02*** | (2006.01) |
| ***C10G 49/22*** | (2006.01) |
| ***C10G 65/04*** | (2006.01) |
| ***C10G 65/16*** | (2006.01) |

(52) U.S. Cl.
CPC ..... *C10G 65/04* (2013.01); *C10G 45/02* (2013.01); *C10G 65/16* (2013.01)

(58) Field of Classification Search
CPC ..... C10G 45/02; C10G 49/22
See application file for complete search history.

(56) References Cited

U.S. PATENT DOCUMENTS

| | | | | |
|---|---|---|---|---|
| 6,444,116 | B1 * | 9/2002 | Galiasso | C10G 49/22 208/311 |
| 6,787,025 | B2 | 9/2004 | Mukherjee et al. | |
| 7,005,057 | B1 | 2/2006 | Kalnes | |
| 7,097,760 | B1 * | 8/2006 | Kalnes | C10G 45/02 208/108 |
| 7,531,082 | B2 | 5/2009 | Mukherjee et al. | |
| 7,547,386 | B1 | 6/2009 | Thakkar et al. | |
| 7,951,290 | B2 | 5/2011 | Thakkar et al. | |
| 8,002,967 | B2 | 8/2011 | Hunter et al. | |
| 8,246,811 | B2 | 8/2012 | Debuisschert et al. | |
| 8,361,309 | B2 | 1/2013 | Lopez et al. | |
| 2012/0294773 | A1 | 11/2012 | Wieber et al. | |

FOREIGN PATENT DOCUMENTS

| | | |
|---|---|---|
| EP | 1752511 | 3/2009 |

* cited by examiner

*Primary Examiner* — Randy Boyer

(74) *Attorney, Agent, or Firm* — James C. Paschall

(57) ABSTRACT

Embodiments of apparatuses and methods for treating a vacuum gas oil (VGO) hydrotreating feed are provided. In one example, a method comprises contacting the VGO hydrotreating feed with a first hydrotreating catalyst in the presence of hydrogen at first hydroprocessing conditions effective to form a first hydrotreated effluent. The first hydrotreated effluent is separated to form a hydrotreated VGO-containing stream and a hydrotreated diesel-containing stream. The hydrotreated VGO-containing stream is stripped and fractionated to form a VGO product stream. The hydrotreated diesel-containing stream is combined with a hydrotreated diesel-, naphtha-containing stream to form a combined stream. The combined stream is stripped to form a diesel product stream.

19 Claims, 1 Drawing Sheet

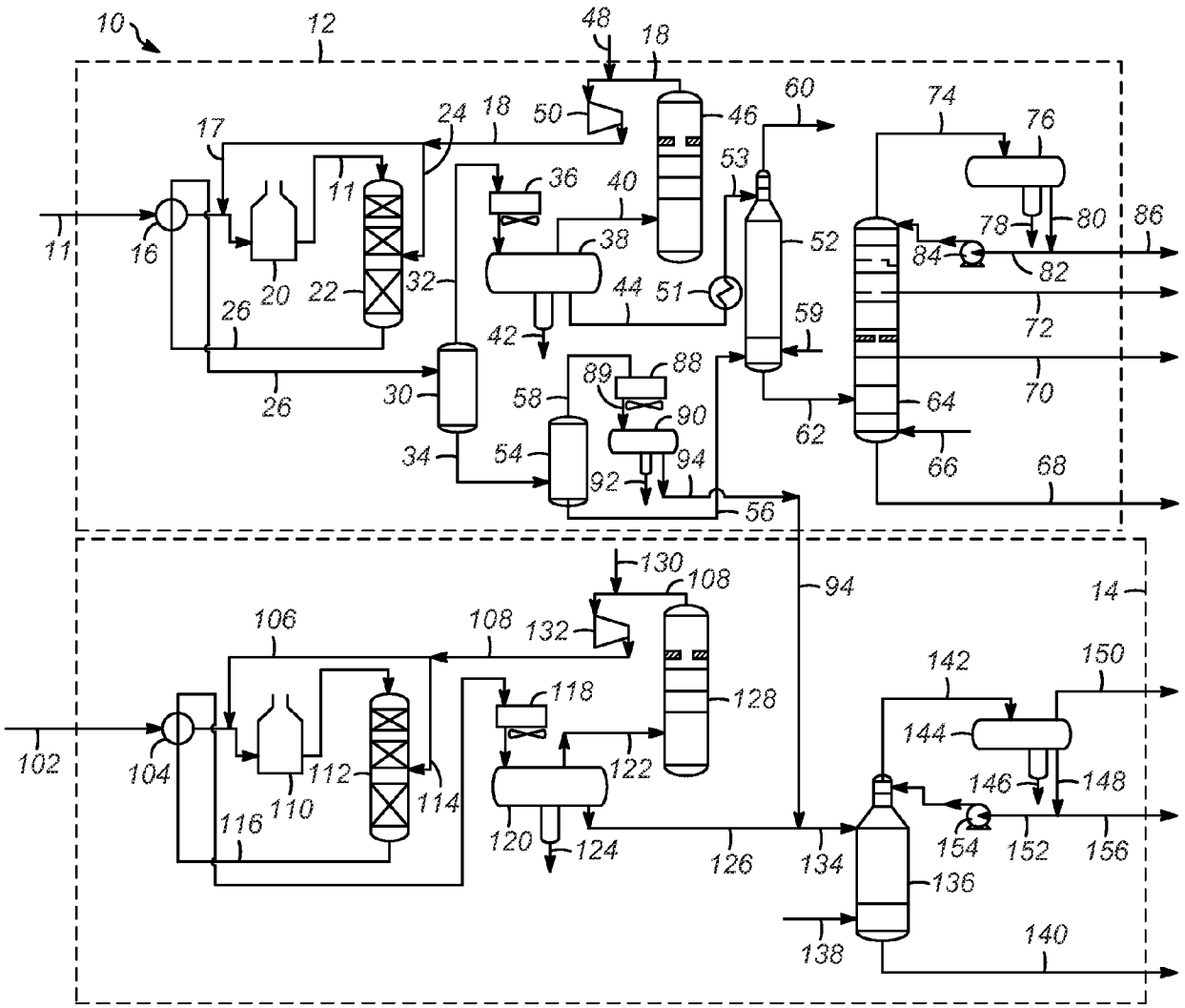
10
12
14
11
16
17
18
20
22
24
26
30
32
34
36
38
40
42
44
46
48
50
51
52
53
54
56
58
59
60
62
64
66
68
70
72
74
76
78
80
82
84
86
88
89
90
92
94
102
104
106
108
110
112
114
116
118
120
122
124
126
128
130
132
134
136
138
140
142
144
146
148
150
152
154
156

METHODS FOR TREATING VACUUM GAS OIL (VGO) AND APPARATUSES FOR THE SAME

TECHNICAL FIELD

The technical field relates generally to methods and apparatuses for treating vacuum gas oil (VGO), and more particularly relates to methods and apparatuses for hydrotreating a VGO hydrotreating feed that contains VGO and diesel range hydrocarbons and further treatment of the hydrotreated effluent to recover a VGO product and a relatively high cetane number diesel product.

BACKGROUND

Vacuum gas oil (VGO) is a hydrocarbon stream recovered from one or more petrochemical refinery unit operations typically as a side cut from a vacuum column, a crude column and/or a coker column and contains sulfur, nitrogen, and other impurities. VGO can include, for example, light vacuum gas oil, heavy vacuum gas oil, heavy coker gas oil, light coker gas oil, and/or heavy atmospheric gas oil. Prior to treating to upgrade the oil, VGO comprises a range of various hydrocarbons (e.g., paraffins, olefins, naphthenes, aromatics with various molecular weights) with different boiling points at atmospheric pressure including a VGO range hydrocarbon fraction and a diesel range hydrocarbon fraction. For example, untreated VGO (e.g., VGO feedstock for treating) can have an initial boiling point (IBP) of from 270 to 350° C. and a final boiling point (FBP) of from 500 to 580° C. in which the VGO range hydrocarbon fraction has an IBP of from 330 to 360° C. and a FBP of from 500 to 580° C. and the diesel range hydrocarbon fraction has an IBP of from 270 to 300° C. and a FBP of from 360 to 400° C.

To remove sulfur, nitrogen and the other impurities and to generally upgrade the oil, VGO is hydrotreated and fractionated to form various hydrotreated effluent product streams that include a VGO product draw stream and a diesel product draw stream. The hydrotreated effluent product stream(s) can then be further treated downstream, for example, by a catalytic cracking process to convert and/or further upgrade the stream(s) to higher value refinery products. Unfortunately, the diesel product draw stream from hydrotreating and fractionating is a relatively low value diesel product having a corresponding relatively low cetane number(s). In particular, a cetane number is a measure of the combustible quality of diesel fuel during compression ignition. Higher cetane numbers (e.g., 52 or greater) correspond to higher value diesel products than diesel products having lower cetane numbers. Additionally, during catalytic cracking process of hydrotreated VGO, the resulting diesel range hydrocarbons typically known as light cycle oil (LCO) are still of relatively low value.

Accordingly, it is desirable to provide apparatuses and methods for treating a VGO feed that comprises primarily VGO and diesel range hydrocarbons to recover a VGO product and a relatively high cetane number diesel product. Furthermore, other desirable features and characteristics of the present invention will become apparent from the subsequent detailed description and the appended claims, taken in conjunction with the accompanying drawings and this background.

BRIEF SUMMARY

Apparatuses and methods for treating a vacuum gas oil (VGO) hydrotreating feed that comprises primarily VGO and diesel range hydrocarbons are provided herein. In accordance with an exemplary embodiment, a method for treating a VGO hydrotreating feed comprises the steps of contacting the VGO hydrotreating feed with a first hydrotreating catalyst in the presence of hydrogen at first hydroprocessing conditions effective to form a first hydrotreated effluent. The first hydrotreated effluent is separated to form a hydrotreated VGO-containing stream and a hydrotreated diesel-containing stream. The hydrotreated VGO-containing stream is stripped and fractionated to form a VGO product stream. The hydrotreated diesel-containing stream is combined with a hydrotreated diesel-, naphtha-containing stream to form a combined stream. The combined stream is stripped to form a diesel product stream.

In accordance with another exemplary embodiment, a method for treating a VGO hydrotreating feed that comprises primarily VGO and diesel range hydrocarbons is provided. The method comprises the steps of contacting the VGO hydrotreating feed with a first hydrotreating catalyst in the presence of hydrogen in a first hydrotreating reactor that is operating at first hydroprocessing conditions effective to form a first hydrotreated effluent. The first hydrotreated effluent is advanced to a hot separator to form a first gas stream that comprises $H_2$, $H_2S$, $NH_3$, and $C_1$-$C_4$ hydrocarbons and a first liquid stream that comprises VGO and diesel range hydrocarbons. The first liquid stream is introduced to a hot flash drum to form a hydrotreated VGO-containing stream and a second gas stream that comprises diesel range hydrocarbons. The hydrotreated VGO-containing stream is stripped in a stripper to form a stripped hydrotreated VGO-containing stream. The stripped hydrotreated VGO-containing stream is fractionated in a fractionator to form a VGO product stream. The second gas stream is cooled and introduced to a cold flash drum to form a hydrotreated diesel-containing stream. The hydrotreated diesel-containing stream is advanced to a diesel hydrotreating and separation zone and combined with a hydrotreated diesel-, naphtha-containing stream to form a combined stream. The combined stream is stripped in the diesel hydrotreating and separation zone to form a diesel product stream.

In accordance with another exemplary embodiment, an apparatus for treating a VGO hydrotreating feed that comprises primarily VGO and diesel range hydrocarbons is provided. The apparatus comprises a VGO hydrotreating and separation zone that is configured to receive the VGO hydrotreating feed. The VGO hydrotreating and separation zone comprises a first hydrotreating reactor that is configured for contacting the VGO hydrotreating feed with a first hydrotreating catalyst in the presence of hydrogen effective to form a first hydrotreated effluent. A hot separator is in fluid communication with the first hydrotreating reactor and is configured to separate the first hydrotreated effluent into a first gas stream that comprises $H_2$, $H_2S$, $NH_3$, and $C_1$-$C_4$ hydrocarbons and a first liquid stream that comprises VGO and diesel range hydrocarbons. A hot flash drum is in fluid communication with the hot separator and is configured to separate the first liquid stream into a hydrotreated VGO-containing stream and a second gas stream that comprises diesel range hydrocarbons. A first stripper is in fluid communication with the hot flash drum and is configured to strip the hydrotreated VGO-containing stream to form a stripped hydrotreated VGO-containing stream. A fractionator is in fluid communication with the first stripper and is configured to fractionate the stripped hydrotreated VGO-containing stream to form a VGO product stream. A cooler and a cold flash drum are in fluid communication with the hot flash drum and are cooperatively configured to cool and remove water from the second gas stream and to form a hydrotreated diesel-containing stream. A diesel hydrotreating and separation zone is in fluid communication with the VGO hydrotreating and separation zone and is configured to receive the hydrotreated diesel-containing stream and a diesel hydrotreating feed that comprises diesel and naphtha range hydrocarbons. The diesel hydrotreating and separation zone comprises a second hydrotreating reactor that is configured for contacting the diesel hydrotreating feed with a second hydrotreating catalyst in the presence of hydrogen effective to form a second hydrotreated effluent. A high pressure separator is in fluid communication with the second hydrotreating reactor and is configured to separate the second hydrotreated effluent into a third gas stream that comprises $H_2$, $H_2S$, and $NH_3$ and a hydrotreated diesel-, naphtha-containing stream. The diesel hydrotreating and separation zone is further configured to combine the hydrotreated diesel-, naphtha-containing stream with the hydrotreated diesel-containing stream to form a combined stream. A second stripper is configured to receive and strip the combined stream to form a diesel product stream.

BRIEF DESCRIPTION OF THE DRAWINGS

The various embodiments will hereinafter be described in conjunction with the following drawing FIGURES, wherein like numerals denote like elements, and wherein:

FIG. 1 schematically illustrates an apparatus and method for treating a vacuum gas oil (VGO) hydrotreating feed in accordance with an exemplary embodiment.

DETAILED DESCRIPTION

The following Detailed Description is merely exemplary in nature and is not intended to limit the various embodiments or the application and uses thereof. Furthermore, there is no intention to be bound by any theory presented in the preceding background or the following detailed description.

Various embodiments contemplated herein relate to apparatuses and methods for treating a vacuum gas oil (VGO) hydrotreating feed that comprises primarily VGO and diesel range hydrocarbons. The exemplary embodiments taught herein introduce the VGO hydrotreating feed to a VGO hydrotreating and separation zone. As used herein, the term "zone" refers to an area including one or more equipment items and/or one or more sub-zones. Equipment items can include one or more reactors or reactor vessels, scrubbers, strippers, fractionators or distillation columns, absorbers or absorber vessels, regenerators, heaters, exchangers, coolers/chillers, pipes, pumps, compressors, controllers, and the like. Additionally, an equipment item can further include one or more zones or sub-zones.

The VGO hydrotreating and separation zone comprises a hydrotreating reactor that contains hydrotreating catalyst in the presence of hydrogen and is operating at hydroprocessing conditions. In an exemplary embodiment, the VGO hydrotreating feed contacts the hydrotreating catalyst to form a hydrotreated effluent. The hydrotreated effluent is separated to form a hydrotreated VGO-containing stream and a hydrotreated diesel-containing stream. The hydrotreated VGO-containing stream is stripped and fractionated to form a VGO product stream.

The hydrotreated diesel-containing stream is advanced to a diesel hydrotreating and separation zone. In an exemplary embodiment, the diesel hydrotreating and separation zone hydrotreats and separates a diesel hydrotreating feed that comprises diesel and naphtha range hydrocarbons to form a hydrotreated diesel-, naphtha-containing stream. The hydrotreated diesel-containing stream is combined with the hydrotreated diesel-, naphtha-containing stream to form a combined stream. The combined stream is stripped in the diesel hydrotreating and separation zone to form a diesel product stream. It has been found that by diverting at least a portion of the hydrotreated diesel range hydrocarbons (e.g., hydrotreated diesel-containing stream) from the VGO hydrotreating and separation zone, thereby avoiding fractionation with the hydrotreated VGO range hydrocarbons, and advancing the hydrotreated diesel-containing stream to the diesel hydrotreating and separation zone to combine and strip with the hydrotreated diesel-, naphtha-containing stream, the resulting diesel product stream including the portion from the VGO hydrotreating and separation zone has a relatively high cetane number. Furthermore, it has been found that by diverting at least a portion of the hydrotreated diesel range hydrocarbons (e.g., hydrotreated diesel-containing stream) from the VGO hydrotreating and separation zone, a significant reduction of the mass flux advancing to the stripping and fractionation section of the VGO hydrotreating and separation zone results in considerable savings in terms of utility stream consumption (e.g., stripping steam, fuel gas in heaters, and the like) as well as energy consumption. This also controls transfer of diesel range material along with hydrotreated VGO to a downstream catalytic cracking process and limits unwanted low value diesel range hydrocarbon material typically known as light cycle oil (LCO) generation.

FIG. 1 schematically illustrates an apparatus 10 for treating a vacuum gas oil (VGO) hydrotreating feed 11. The apparatus 10 comprises a VGO hydrotreating and separation zone 12 and a diesel hydrotreating and separation zone 14 that is in fluid communication with the VGO hydrotreating and separation zone 12.

The VGO hydrotreating feed 11 is introduced to the VGO hydrotreating and separation zone 12. In an exemplary embodiment, the VGO hydrotreating feed 11 is a stream formed from one or more petrochemical refinery unit operations, such as a side cut(s) from a vacuum column, a crude column, and/or a coker column. The VGO hydrotreating feed 11 comprises a variety of hydrocarbons, such as paraffins, olefins, naphthenes, and aromatics, having boiling points at atmospheric conditions of from about 270 to about 580° C. In an exemplary embodiment, the VGO hydrotreating feed 11 comprises primarily VGO and diesel range hydrocarbons, sulfur, nitrogen, and possibly other impurities. In an exemplary embodiment, at atmospheric conditions, the VGO range hydrocarbons have an IBP of from about 270 to about 350° C. and a FBP of from about 500 to about 580° C. and the diesel range hydrocarbons have an IBP of from about 270 to about 300° C. and a FBP of from about 360 to about 400° C.

In an exemplary embodiment, the VGO hydrotreating feed 11 is introduced to VGO hydrotreating and separation zone 12 at a temperature of about 20 to about 160° C. The VGO hydrotreating feed 11 is passed through a heat exchanger 16, combined with a portion 17 of a $H_2$-rich stream 18, and is further advanced through a heater 20 to a hydrotreating reactor 22. A remaining portion 24 of the $H_2$-rich stream 18 is introduced directly to the hydrotreating reactor 22. In an exemplary embodiment, the VGO hydrotreating feed 11 is introduced to the hydrotreating reactor 22 at a temperature of from about 300 to about 400° C.

The hydrotreating reactor 22 contains a hydrotreating catalyst. Hydrotreating catalysts are well known and typically comprise molybdenum (Mo), tungsten (W), cobalt (Co), and/or nickel (Ni) on a support comprised of alpha-alumina and/or combination of silica-alumina. In an exemplary embodiment, the hydrotreating reactor 22 is operating at hydroprocessing conditions that include a temperature of from about 300 to about 460° C. and a pressure of from about 50 to about 100 $kg/cm^2 \cdot g$. In the hydrotreating reactor 22, the VGO hydrotreating feed 11 contacts the hydrotreating catalyst in the presence of hydrogen to convert some of the sulfur and nitrogen from the VGO hydrotreating feed 11 to $H_2S$ (e.g., via combining sulfur with hydrogen) and $NH_3$ (e.g., via combining nitrogen with hydrogen), respectively, to form a hydrotreated effluent 26. In an exemplary embodiment, the hydrotreated effluent 26 has a temperature of from about 300 to about 460° C.

The hydrotreated effluent 26 exits the hydrotreating reactor 22 and is passed through the heat exchanger 16 for indirect heat exchange with the VGO hydrotreating feed 11. The hydrotreated effluent 26 is then advanced downstream to the hot separator 30. In an exemplary embodiment, the hydrotreated effluent 26 is introduced to the hot separator 30 at a temperature of from about 250 to about 300° C. In the hot separator 30, light ends such as $H_2$ and $C_1$-$C_4$ hydrocarbons, and $H_2S$, $NH_3$, and $H_2O$ are removed from the hydrotreated effluent 26 to form a gas stream 32 and a liquid stream 34 that comprises VGO and diesel range hydrocarbons. In an exemplary embodiment, the hot separator 30 is operating at a temperature of from about 250 to about 300° C. and a pressure of from about 40 to about 80 kg/cm2·g.

The gas stream 32 exits the hot separator 30 and is passed along through a cooler 36 to a high pressure separator 38. In an exemplary embodiment, after being cooled, the gas stream 32 is introduced to the high pressure separator 38 as a two-phase stream at a temperature of from about 50 to about 70° C. In an exemplary embodiment, the high pressure separator 38 is operating at a pressure of from about 40 to about 100 kg/cm2·g. In the high pressure separator 38, $H_2$, $H_2S$, and $NH_3$ are removed to form a gas stream 40, $H_2O$ and various salts are removed to form a sour water stream 42, and the remaining portion forms a liquid stream 44 comprising $C_1$-$C_4$ hydrocarbons.

The gas stream 40 exits the high pressure separator 38 and is introduced to a scrubber 46 to remove $H_2S$ and $NH_3$ and form the $H_2$-rich stream 18. As illustrated, a $H_2$-makeup stream 48 may optionally be introduced to the $H_2$-rich stream 18 prior to the $H_2$-rich stream 18 being passed through the compressor 50 for recycling back to the hydrotreating reactor 22. The liquid stream 44 exits the high pressure separator 38 and is passed through a heater 51 to form stream 53 that is introduced to a stripper 52. In an exemplary embodiment, the stream 53 is introduced to the stripper 52 at a temperature of from about 150 to about 200° C.

As illustrated, the liquid stream 34 exits the hot separator 30 and is passed along to a hot flash drum 54. In the hot flash drum 54, the liquid stream 34 flashes and is separated to form a hydrotreated VGO-containing stream 56 as a liquid stream that comprises VGO range hydrocarbons and a gas stream 58 that comprises diesel range hydrocarbons. In an exemplary embodiment, the liquid stream 34 flashes in the hot flash drum 54 at a temperature of from about 250 to about 300° C. and a pressure of from about 25 to about 40 kg/cm2·g.

The hydrotreated VGO-containing stream 56 exits the hot flash drum 54 and is passed along and introduced to the stripper 52. In the stripper 52, high-pressure steam 59 strips the stream 53 and the hydrotreated VGO-containing stream 56 to form an off gas stream 60 and a stripped hydrotreated VGO-containing stream 62. In an exemplary embodiment, the off gas stream 60 comprises any remaining $H_2S$, $NH_3$, and lighter end hydrocarbons, e.g., $C_1$-$C_4$ hydrocarbons, and the stripped hydrotreated VGO-containing stream 62 comprises VGO range hydrocarbons, and to a lesser extent diesel range hydrocarbons, kerosene, and naphtha.

As illustrated, the stripped hydrotreated VGO-containing stream 62 is passed along to a fractionator 64. Low pressure steam 66 is introduced to the fractionator 64 and the stripped hydrotreated VGO-containing stream 62 is separated into a VGO product stream 68, a diesel stream 70, a kerosene stream 72, and a vapor stream 74. In an exemplary embodiment, the diesel stream 70 is a relatively low value diesel product having a cetane number of less than about 52. As will be discussed in further detail below, some of the diesel range hydrocarbons are diverted from the VGO hydrotreating and separation zone 12 to produce a higher value diesel product than the diesel stream 70. The vapor stream 74 is passed along to a receiver 76 to form a sour water stream 78 and a naphtha stream 80. The naphtha stream 80 is divided into a reflux portion 82 and a product portion 86. The reflux portion 82 is passed through a pump 84 and returned as reflux to the fractionator 64. The product streams 68, 70, 72, and 86 are removed from the VGO hydrotreating and separation zone 12 for further processing downstream.

The gas stream 58 exits the hot flash drum 54 and is passed through a cooler 88 to form a cooled stream 89. The cooled stream 89 is introduced to a cold flash drum 90 and separated to form a sour water stream 92 and a hydrotreated diesel-containing stream 94. In an exemplary embodiment, the cooled stream 89 is separated in the cold flash drum 90 at a temperature of from about 50 to about 70° C. In an exemplary embodiment, the hydrotreated diesel-containing stream 94 contains a substantial portion of the diesel range hydrocarbons that were originally present in the VGO hydrotreating feed 11 and has a diesel range content of about 25 vol. % or greater, for example from about 30 to about 50 vol. % of the hydrotreated diesel-containing stream 94. As illustrated, the hydrotreated diesel-containing stream 94 exits the cold flash drum 90 and the VGO hydrotreating and separation zone 12, and is introduced to the diesel hydrotreating and separation zone 14.

A diesel hydrotreating feed 102 is introduced to the diesel hydrotreating and separation zone 14. In an exemplary embodiment, the diesel hydrotreating feed 102 is a stream formed from one or more petrochemical refinery unit operations, such as a relatively light cut(s) from a vacuum column, a crude column and/or a coker column. The diesel hydrotreating feed 102 comprises a variety of hydrocarbons, such as paraffins, olefins, naphthenes, and aromatics, having boiling points at atmospheric conditions of from about 60 to about 400° C. In an exemplary embodiment, the diesel hydrotreating feed 102 comprises diesel and naphtha range hydrocarbons, sulfur, nitrogen, and possibly other impurities. In an exemplary embodiment, at atmospheric conditions, the naphtha range hydrocarbons have an IBP of from 40 to 60° C. and a FBP of from 160 to 200° C. and the diesel range hydrocarbons have an IBP and a FBP as discussed above in relation to the VGO hydrotreating feed 11.

In an exemplary embodiment, the diesel hydrotreating feed 102 is introduced to the diesel hydrotreating and separation zone 14 at a temperature of about 20 to about 160° C. The diesel hydrotreating feed 102 is passed through a heat exchanger 104, combined with a portion 106 of a $H_2$-rich stream 108, and is further advanced through a heater 110 to a hydrotreating reactor 112. A remaining portion 114 of the $H_2$-rich stream 108 is introduced directly to the hydrotreating reactor 112. In an exemplary embodiment, the diesel hydrotreating feed 102 is introduced to the hydrotreating reactor 112 at a temperature of from about 300 to about 400° C.

The hydrotreating reactor 112 contains a hydrotreating catalyst. The hydrotreating catalyst of the hydrotreating reactor 112 can be of the same chemical composition and structure as the hydrotreating catalyst used in the hydrotreating reactor 22 as discussed above. In an exemplary embodiment, the hydrotreating reactor 112 is operating at hydroprocessing conditions that include a temperature of from about 300 to about 440° C. and a pressure of from about 40 to about 60 $kg/cm^2 \cdot g$. In the hydrotreating reactor 112, the diesel hydrotreating feed 102 contacts the hydrotreating catalyst in the presence of hydrogen to convert some of the sulfur and nitrogen from the diesel hydrotreating feed 102 to $H_2S$ and $NH_3$, respectively, to form a hydrotreated effluent 116. In an exemplary embodiment, the hydrotreated effluent 116 has a temperature of from about 300 to about 440° C.

The hydrotreated effluent 116 exits the hydrotreating reactor 112 and is passed through the heat exchanger 104 for indirect heat exchange with the diesel hydrotreating feed 102. The hydrotreated effluent 116 is then passed along through a cooler 36 to a high pressure separator 120. In an exemplary embodiment, the hydrotreated effluent 116 is introduced to the high pressure separator 120 as a two-phase stream at a temperature of from about 50 to about 70° C. In an exemplary embodiment, the high pressure separator 120 is operating at a pressure of from about 30 to about 55 kg/cm2·g. In the high pressure separator 120, $H_2$, $H_2S$, and $NH_3$ are removed to form a gas stream 122, $H_2O$ and various salts are removed to form a sour water stream 124, and the remaining portion forms a hydrotreated diesel-, naphtha-containing stream 126.

As illustrated, the gas stream 122 exits the high pressure separator 120 and is introduced to a scrubber 128 to remove $H_2S$ and $NH_3$ and form the $H_2$-rich stream 108. A $H_2$-makeup stream 130 may optionally be introduced to the $H_2$-rich stream 108 prior to the $H_2$-rich stream 108 being passed through the compressor 132 for recycling back to the hydrotreating reactor 112.

The hydrotreated diesel-, naphtha-containing stream 126 exits the high pressure separator 120 and is combined with the hydrotreated diesel-containing stream 94 to form a combined stream 134. In an exemplary embodiment, the combined stream 134 has a temperature of from about 50 to about 70° C.

As illustrated, the combined stream 134 is introduced to a stripper 136. High pressure steam 138 is used to strip the combined stream 134 to form a diesel product stream 140 and a vapor stream 142. The vapor stream 142 is passed along to a receiver 144 to form a sour water stream 146, a naphtha stream 148, and an off gas stream 150. The naphtha stream 148 is divided into a reflux portion 152 and a product portion 156. The reflux portion 152 is passed through a pump 154 and returned as reflux to the stripper 136 and the product portion 156 exits the diesel hydrotreating and separation zone 14 for further processing downstream. In an exemplary embodiment, the diesel product stream 140 is a relatively high quality diesel product having a cetane number of about 52 or greater.

Accordingly, apparatuses and methods for treating a VGO hydrotreating feed have been described. The exemplary embodiments taught herein comprises contacting the VGO hydrotreating feed with a first hydrotreating catalyst in the presence of hydrogen at first hydroprocessing conditions effective to form a first hydrotreated effluent. The first hydrotreated effluent is separated to form a hydrotreated VGO-containing stream and a hydrotreated diesel-containing stream. The hydrotreated VGO-containing stream is stripped and fractionated to form a VGO product stream. The hydrotreated diesel-containing stream is combined with a hydrotreated diesel-, naphtha-containing stream to form a combined stream. The combined stream is stripped to form a diesel product stream.

While at least one exemplary embodiment has been presented in the foregoing detailed description of the disclosure, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing an exemplary embodiment of the disclosure. It being understood that various changes may be made in the function and arrangement of elements described in an exemplary embodiment without departing from the scope of the disclosure as set forth in the appended claims.

What is claimed is:

1. A method for treating a vacuum gas oil (VGO) hydrotreating feed that comprises primarily VGO and diesel range hydrocarbons, the method comprising the steps of:

contacting the VGO hydrotreating feed with a first hydrotreating catalyst in the presence of hydrogen at first hydroprocessing conditions effective to form a first hydrotreated effluent;

separating the first hydrotreated effluent to form a hydrotreated VGO-containing stream and a hydrotreated diesel-containing stream;

stripping and fractionating the hydrotreated VGO-containing stream to form a VGO product stream;

combining the hydrotreated diesel-containing stream with a hydrotreated diesel-, naphtha-containing stream to form a combined stream; and stripping the combined stream to form a diesel product stream.

2. The method of claim 1, wherein the step of contacting comprises contacting the VGO hydrotreating feed at the first hydroprocessing conditions that include a temperature of from about 300 to about 460° C.

3. The method of claim 1, wherein the step of contacting comprises contacting the VGO hydrotreating feed at the first hydroprocessing conditions that include a pressure of from about 50 to about 100 $kg/cm^2 \cdot g$.

4. The method of claim 1, wherein the step of separating comprises forming the hydrotreated diesel-containing stream having a diesel range content of about 25 vol. % or greater.

5. The method of claim 4, wherein the step of separating comprises forming the hydrotreated diesel-containing stream having the diesel range content of from about 30 to about 50 vol. %.

6. The method of claim 1, wherein the step of stripping the combined stream comprises forming the diesel product stream having a cetane number of about 52 or greater.

7. The method of claim 1, further comprising:

contacting a diesel hydrotreating feed that comprises diesel and naphtha range hydrocarbons with a second hydrotreating catalyst in the presence of hydrogen at second hydroprocessing conditions effective to form a second hydrotreated effluent;

separating the second hydrotreated effluent to form a gas stream that comprises $H_2$, $H_2S$, and $NH_3$ and the hydrotreated diesel-, naphtha-containing stream.

8. The method of claim 7, wherein the step of contacting the diesel hydrotreating feed comprises contacting the diesel hydrotreating feed with the second hydrotreating catalyst at the second hydroprocessing conditions that include a temperature of from about 300 to about 440° C.

9. The method of claim 7, wherein the step of contacting the diesel hydrotreating feed comprises contacting the diesel hydrotreating feed with the second hydrotreating catalyst at the second hydroprocessing conditions that include a pressure of from about 40 to about 60 $kg/cm^2 \cdot g$.

10. The method of claim 7, wherein the step of separating the second hydrotreated effluent comprises separating the second hydrotreated effluent at a temperature of from about 50 to about 70° C.

11. The method of claim 7, wherein the step of separating the second hydrotreated effluent comprises separating the second hydrotreated effluent at a pressure of from about 30 to about 55 $kg/cm^2 \cdot g$.

12. The method of claim 1, wherein the step of combining comprises forming the combined stream having a temperature of from about 50 to about 70° C.

13. The method of claim 1, wherein the step of stripping the combined stream comprises stripping the combined stream at a temperature of from about 320 to about 350° C.

14. A method for treating a vacuum gas oil (VGO) hydrotreating feed that comprises primarily VGO and diesel range hydrocarbons, the method comprising the steps of:

contacting the VGO hydrotreating feed with a first hydrotreating catalyst in the presence of hydrogen in a first hydrotreating reactor that is operating at first hydroprocessing conditions effective to form a first hydrotreated effluent;

advancing the first hydrotreated effluent to a hot separator to form a first gas stream that comprises $H_2$, $H_2S$, $NH_3$, and $C_1$-$C_4$ hydrocarbons and a first liquid stream that comprises VGO and diesel range hydrocarbons;

introducing the first liquid stream to a hot flash drum to form a hydrotreated VGO-containing stream and a second gas stream that comprises diesel range hydrocarbons;

stripping the hydrotreated VGO-containing stream in a stripper to form a stripped hydrotreated VGO-containing stream;

fractionating the stripped hydrotreated VGO-containing stream in a fractionator to form a VGO product stream;

cooling and introducing the second gas stream to a cold flash drum to form a hydrotreated diesel-containing stream;

advancing the hydrotreated diesel-containing stream to a diesel hydrotreating and separation zone and combining with a hydrotreated diesel-, naphtha-containing stream to form a combined stream; and stripping the combined stream in the diesel hydrotreating and separation zone to form a diesel product stream.

15. The method of claim 14, wherein the step of advancing the first hydrotreated effluent comprises separating the first hydrotreated effluent in the hot separator at a temperature of from about 250 to about 300° C.

16. The method of claim 14, wherein the step of advancing the first hydrotreated effluent comprises separating the first hydrotreated effluent in the hot separator at a pressure of from about 40 to about 80 $kg/cm^2 \cdot g$.

17. The method of claim 14, wherein the step of introducing the first liquid stream comprises flashing the first liquid stream in the hot flash drum at a temperature of from about 250 to about 300° C.

18. The method of claim 14, wherein the step of introducing the first liquid stream comprises flashing the first liquid stream in the hot flash drum at a pressure of from about 25 to about 40 $kg/cm^2 \cdot g$.

19. The method of claim 14, wherein the step of cooling and introducing the second gas stream comprises separating the second gas stream in the cold flash drum at a temperature of from about 50 to about 70° C.

* * * * *